US005840669A

United States Patent [19]

Neelakantan

[11] Patent Number: 5,840,669

[45] Date of Patent: Nov. 24, 1998

[54] HERBAL DRY CLEANING POWDER COMPOSITION

[75] Inventor: Kameswaran Neelakantan, Chennai, India

[73] Assignee: Gem Energy Industry Limited, Chennai, India

[21] Appl. No.: 984,252

[22] Filed: Dec. 3, 1997

[30] Foreign Application Priority Data

Jun. 20, 1997 [IN] India ..... 1350/97

[51] Int. Cl.[6] ..... C11D 3/382; C11D 3/48

[52] U.S. Cl. ..... 510/344; 510/319; 510/438

[58] Field of Search ..... 510/344, 319, 510/438

[56] References Cited

U.S. PATENT DOCUMENTS

| | | | |
|---|---|---|---|
| 4,581,230 | 4/1986 | Grollier et al. | 424/74 |
| 4,767,618 | 8/1988 | Grollier et al. | 424/74 |
| 5,578,312 | 11/1996 | Parrinello | 424/401 |

*Primary Examiner*—Ardith Hertzog
*Assistant Examiner*—Gregory E. Webb

[57] ABSTRACT

A herbal dry cleansing powder composition comprising about 6–12% by weight of *Cocoa nucifera,* about 6–12% by weight of *Hibiscus Rosa sinesis,* about 6–12% by weight of *Sapindus trifoliatus, about 6–12* by weight of *Trigonella foenum graeceum,* about 4–9% by weight of *Melia azadirachta and about 43–72* by weight of a preservative. To prepare the composition the constituents are cleaned, dried and crushed to a mesh size of 150–350 sieve size.

8 Claims, No Drawings

HERBAL DRY CLEANING POWDER COMPOSITION

The present invention relates to a herbal dry cleaning powder composition and a process for preparing the composition.

BACKGROUND OF THE INVENTION

Dry cleaning synthetic powders are known in the art and have been found to be particularly popular largely because of the claimed cleansing capabilities. Many available cleansing powders are synthetic and they have been found to be injurious to the skin or hand of the user despite that it is stated that these cleaning powders do not contain harmful/toxic constituents.

The existing cleansing powders that are available in the market are mainly made out of inorganic chemicals, and even some of the so called herbal cleansing powders contain inorganic chemicals to maintain their shelf life. The inorganic chemicals in the cleansing powders are injurious to the hands and skin of the user.

Many herbal cleaning powders have been used in the past. However, with the modernization of society, there has been a trend toward the use of synthetic cleaning powders. The use of herbal cleaning powders has been avoided because production of these powders is more labor intensive than the production of synthetic detergents.

Advantages of the present invention are that the composition is 100% herbal, it includes constituents which are excellent in maintaining the texture and color of fabric and thus increasing the life of the fabric.

Other advantages of the present invention are that the composition is completely biodegradable and non-toxic, no synthetic chemicals are used in the composition, and the composition is insecticidal and germicidal.

SUMMARY OF THE INVENTION

The cleansing powder compositions of this invention comprise a mixture of herbs.

The constituents of the composition are:

about 43–72% by weight of *Bassia malabarica,* about 6–12% by weight of *Cocoa nucifera,* about 6–12% by weight of *Hibiscus Rosa sinesis,* about 6–12% by weight of *Sapindus trifoliatus,* about 6–12% by weight of *Trigonella foenum graeceum, and* about 4–9% by weight of *Melia azadirachta.*

*Bassia malabarica:* One of the major constituents in the present composition. It is a herb from the genus Aisandra from the family Sapotaceae, large deciduous trees. The bark is dark reddish brown or dull black in color; leaves are long obveate-oblong or elliptic, pinkish white in color, clustered at the end of branches having flowers of white or pale yellow color. The leaves of the herb are used to prepare the composition of this invention. The leaves make an excellent soap/detergent in the present cleansing composition. The leaves act as a preservative. The present composition comprises about 43–72% by weight of leaves of *Bassia malabarica.*

*Cocoa nucifera:* A herb extracted from the genus Cocos of family Palmae. A tall and stately growing plant bearing a crown of large pinnate leaves. It contains potash and caprylic acid. It is used as foaming accelerating agent in the present composition. The subject composition comprises 6–12% by weight of the kernal of *Cocoa nucifera.*

*Hibiscus Rosa sinesis*: Belongs to the genus Hibiscus from the family Malvaceae, a woody, glabrous, showy shrub having bright green leaves, flowers are solitary, axillary, bell-shaped, large, 4–6 inches in diameter with pistil and stamens projecting from the center, many contain seeds. It is used to recreate pigmentation and/or maintain the color of the fabric because of the presence of anthocyanin pigment. In the subject composition the flowers of the herb is used in the amount of 6–12% by weight of the composition.

*Sapindus trifoliatus*: A herb from the genus Sapindus from the family Sapindaceae. A medium sized deciduous tree having shiny grey bark covered with rough, deciduous scale, having abruptly pinnate leaves and white colored flowers, seeds are pea-sized enclosed in blackish, smooth, hard endocarp, normally used as detergent for washing fabrics before dying to increase the retaining power of the fabric and mainly used as a foaming agent in the present cleansing powder composition. The subject composition comprises 6–12% by weight of the seeds of this herb.

*Trigonella foenum graeceum*: A herb from the genus Trigonella from the family Leguminosae is an aromatic plant having pinnate, tri-foliate leaves and yellowish colored flowers. The seeds are greenish brown in color, oblong with a deep groove across one comer giving the seeds a hooked appearance. In the subject composition the seed of Trigonella Forenum Graceum is used in the amount of 6–12% by weight of the composition.

*Melia azadirachta*: A herb from the genus Melia from the family Meliaceae. A moderate sized deciduous tree having dark grey bark with shallow longitudinal furrows, having bi-pinnate leaves and lilac flowers, fruits are ellipsoid-globose druped with 4–5 seeds. The subject composition comprises 4–9% by weight of the leaves of this herb. In the present invention, the leaves act as an insect repellant and insecticide.

The present invention relates to a herbal dry cleansing powder composition comprising:

about 6–12% by weight of *Cocoa nucifera,* about 6–12% by weight of *Hibiscus Rosa sinesis,* about 6–12% by weight of *Sapindus trifoliatus,* about 6–12% by weight of *Trigonella foenum graeceum,* about 4–9% by weight of *Melia azadirachta* and about 43–72% by weight of a preservative, preferably *Bassia malabarica.*

To prepare this composition the constituents of the herbs are cleaned, dried and crushed to a mesh size of 150–350 sieve size. The pH of the final composition is maintained at 6–9.

All the above mentioned constituents of the present composition are plucked and processed comprising the steps of:

Cleaning of the constituents: The constituents are cleaned by conventional methods to remove all the superfluous dust and other foreign particles.

Drying of the constituents: The constituents are dried at ambient temperatures. It is preferred that they be dried in the open atmosphere.

Crushing of the constituents in a pulverizer: All of the constituents are crushed, preferably in a pulverizer to a mesh size of 150–350. At the time of crushing the constituents, the pH is maintained at 7. A pH adjusting agent such as sodium bicarbonate is used to adjust the pH.

Packing of the mixture: After the desired mesh size is achieved the powdered mixture is removed from the pulverizer and packed.

The mixture so prepared has a shelf life of more than three years under normal conditions and at ambient temperature because of the presence of the preservative. *Bassia malabarica* is a preferred preservative in this composition.

The present invention is illustrated by the examples given below which should not be construed to limit the scope of the invention.

EXAMPLE-I

The following herbs are used in the preparation of a herbal dry cleansing powder composition comprising:

from about 9–12% by weight of *Cocoa nucifera,* from about 9–12% by weight of *Hibiscus Rosa sinesis,* from about 9–12% by weight of *Sapindus trifoliatus,* from about 9–12% by weight of *Trigonella foenum graeceum,* from about 5–9% by weight of *Melia azadirachta* and from about 43–59% by weight of *Bassia malabarica*

The constituents are cleaned, dried at ambient temperatures and crushed to a mesh size of 175–275 sieve size maintaining the pH at 6–9, and finally packed.

EXAMPLE-II

The following herbs are used in the preparation of a herbal dry cleansing powder composition comprising:

from about 6–10% by weight of *Cocoa nucifera,* from about 6–10% by weight of *Hibiscus Rosa sinesis,* from about 6–10% by weight of *Sapindus trifoliatus,* from about 6–10% by weight of *Trigonella foenum graeceum,* from about 4–8% by weight of *Melia azadirachta* and from about 52–72% by weight of *Bassia malabarica.*

The constituents are cleaned, dried at ambient temperatures and crushed to a mesh size of 150–350 sieve size maintaining the pH at 6–9, and finally packed.

Therefore the present invention is advantageous because the present herbal cleansing powder composition is a 100% herbal product having no synthetic or artificial chemicals added. In the present invention no artificial preservative is used to increase the shelf life of the product as the natural herbs of the present composition themselves acts as preservatives. The present composition has a shelf life of more than three years without any contamination or fungal growth.

The present composition is a very economical one as all the essential ingredients are natural and are found in abundance. All the important constituents of the present invention are nontoxic. The present composition has insect-repellant and insecticidal properties thereby enhancing the life of fabric by saving it from insects.

We claim:

1. A herbal dry cleansing powder composition comprising constituents in the amount of about 6–12% by weight of *Cocoa nucifera,* about 6–12% by weight of *Hibiscus Rosa sinesis,* about 6–12% by weight of *Sapindus trifoliatus,* about 6–12% by weight of *Trigonella foenum graeceum,* about 4–9% by weight of *Melia azadirachta* and about 43–72% by weight of a preservative.

2. A herbal dry cleansing powder composition as claimed in claim 1 wherein the preservative is *Bassia malabarica.*

3. A herbal dry cleansing powder composition as claimed in claim 2 prepared by the process of cleaning of the constituents, said constituents being kernals of *Cocoa nucifera,* flowers of *Hibiscus Rosa sinesis,* seeds of *Sapindus trifoliatus,* seeds of *Trigonella foenum graeceum,* leaves of *Melia azadirachta* and leaves of *Bassia malabarica,* drying of the cleaned constituents at ambient temperatures, crushing of the constituents and mixing the crushed constituents.

4. A composition according to claim 2 where the constituents are cleaned, dried and crushed to a mesh size of 150–350 sieve size and having a pH of 6–9.

5. A herbal dry cleansing powder composition as claimed in claim 1 wherein the mesh size of the composition is 200–300 sieve size.

6. A herbal dry cleansing powder composition as claimed in claim 3 wherein the pH is maintained at 7 at the time of crushing of the constituents.

7. A herbal dry cleansing powder composition according to claim 1 having a shelf life of more than three years.

8. A herbal dry cleansing powder composition according to claim 2 having a shelf life of more than three years.

* * * * *